US006746167B2

(12) United States Patent
Ahmed

(10) Patent No.: US 6,746,167 B2
(45) Date of Patent: Jun. 8, 2004

(54) MULTICOLOR MARKER

(76) Inventor: Cynthia G. Ahmed, 16672 80th Avenue, Surrey, BC (CA), V3S6T9

( * ) Notice: Subject to any disclaimer, the term of this patent is extended or adjusted under 35 U.S.C. 154(b) by 0 days.

(21) Appl. No.: 10/418,478

(22) Filed: Apr. 21, 2003

(65) Prior Publication Data

US 2003/0194256 A1 Oct. 16, 2003

Related U.S. Application Data

(62) Division of application No. 09/991,414, filed on Nov. 23, 2001, now Pat. No. 6,554,517.

(60) Provisional application No. 60/306,240, filed on Jul. 19, 2001.

(51) Int. Cl.[7] ..... B43K 27/04

(52) U.S. Cl. ..... 401/35

(58) Field of Search ..... 401/34–38, 16–18

(56) References Cited

U.S. PATENT DOCUMENTS

| | | | | | |
|---|---|---|---|---|---|
| 3,194,426 | A | * | 7/1965 | Brown, Jr. | 220/23.4 |
| 3,442,595 | A | | 5/1969 | Dumas | |
| 3,750,292 | A | | 8/1973 | Dodge | |
| 3,862,683 | A | * | 1/1975 | Koelichen | 206/207 |
| 4,580,918 | A | | 4/1986 | Baker | |
| 5,044,804 | A | * | 9/1991 | Chuang | 401/34 |
| 5,116,153 | A | | 5/1992 | Tully | |
| 5,306,092 | A | | 4/1994 | Jenq | |
| 5,368,405 | A | | 11/1994 | Sixiong | |
| 5,388,924 | A | | 2/1995 | Chao | |
| 5,971,643 | A | | 10/1999 | Ahmed | |
| 6,149,330 | A | * | 11/2000 | Chuang | 401/57 |
| 6,155,733 | A | | 12/2000 | Holbrook et al. | |

FOREIGN PATENT DOCUMENTS

| | | |
|---|---|---|
| CH | 0656839 A5 | 7/1986 |
| DE | 2800960 | 3/1970 |
| DE | DT-2615810 A1 | 10/1977 |
| DE | DT-2616439 | 10/1977 |
| FR | 365198 | 9/1906 |
| FR | 971843 | 1/1951 |
| GB | 1348135 | 3/1974 |
| WO | WO 94/09997 | 5/1994 |

* cited by examiner

*Primary Examiner*—Gregory Huson
*Assistant Examiner*—Huyen Le
(74) *Attorney, Agent, or Firm*—Oltman, Flynn & Kubler

(57) ABSTRACT

A multicolor marker with a plurality of marking nibs that individually receive ink of different colors or shades. The nibs have marking surfaces that are elongated in one direction and can be selectively aligned end-to-end to produce a continuous line whose color changes from one nib to the next.

10 Claims, 7 Drawing Sheets

Fig. 22
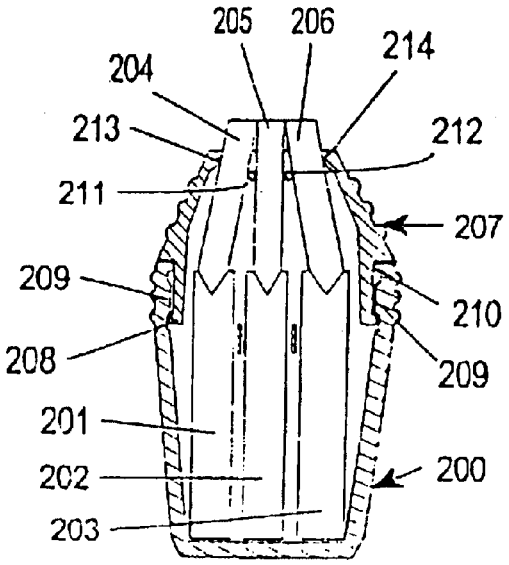
Fig. 23
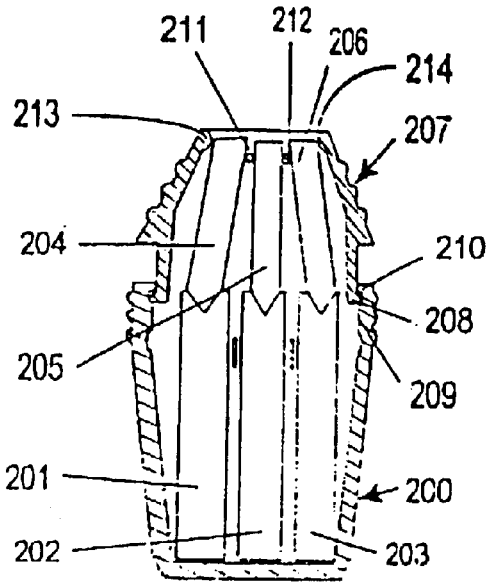
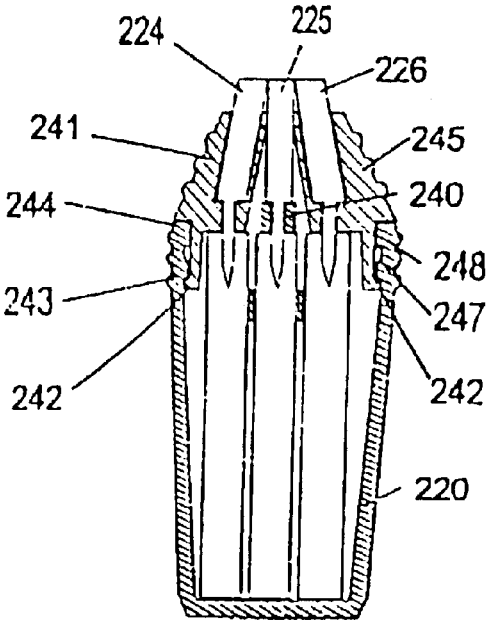
Fig. 24
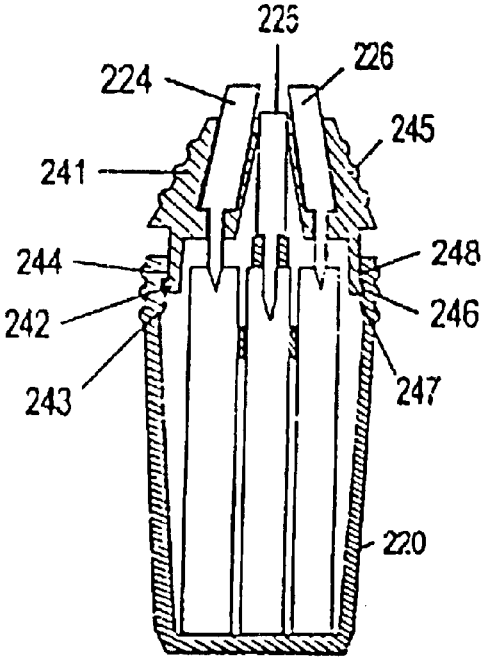
Fig. 25

MULTICOLOR MARKER

This application is a division of co-pending application Ser. No. 09/991,414 filed Nov. 23, 2001 now U.S. Pat. No. 6,554,517. Applicant claims the benefit of the filing date of her provisional application No. 60/306,240 filed on Jul. 19, 2001.

BACKGROUND OF THE INVENTION

Field of the Invention

This invention relates to a marker enabling the user to make simultaneous markings of different colors (including different shades of a particular color) side-by-side or with a selected spacing between them.

Various multicolor markers have been proposed heretofore in which closely spaced marking nibs of relatively small cross-section are held at one end of a marker housing and are supplied with ink of different colors, or different shades of one color, from separate ink supplies in the marker housing. The following U.S. patents disclose such markers:

Sixiong U.S. Pat. No. 5,368,405; Rosh U.S. Pat. No. 3,887,287; and Tully U.S. Pat. No. 5,116,153.

Chao U.S. Pat. No. 5,388,924 discloses a drawing pen in which separate reservoirs in the pen barrel supply different shades of ink to adjoining drawing tips attached to each other by a watertight bonding agent.

Baker et al U.S. Pat. No. 4,580,918 discloses a pen with coaxial nibs of small cross-section, one of the nibs being retractable so that the pen is capable of producing lines of different predetermined widths.

Ahmed U.S. Pat. No. 5,971,5643 discloses a multicolor marker with a single housing that separately holds plural marking liquids for respective adjoining segments of a marking nib.

Jenq U.S. Pat. No. 5,306,092 discloses a marking pen with a single marking head for receiving different colored ink from several tubes to produce multicolored effects.

SUMMARY OF THE INVENTION

The present invention is a multicolor marker having a plurality of identical marker modules that can be selectively positioned to extend side-by-side with their marking nibs exposed adjacent one another either to produce contiguous markings of different colors or shades on the marking surface or to produce different colored or shaded markings of selected widths and spacings close to each other.

A principal object of this invention is to provide a multicolor marker of novel modular construction that enables greater adjustability to produce a selected variety of multicolor marking effects.

Another object of this invention is to provide a novel multicolor marker having a number of identical marker modules that can be selectively held in a side-by-side relationship to produce the desired multicolor marking.

Further objects and advantages of the invention will be apparent from the following detailed description of several presently preferred embodiments thereof which are illustrated in the accompanying drawings.

BRIEF DESCRIPTION OF THE DRAWINGS

FIG. 22 is a longitudinal section through a multicolor marker in accordance with a fifth embodiment of this invention in one position of its operating parts;

FIG. 23 is a similar view showing the operating parts of the FIG. 22 marker in a different position;

FIG. 24 is a longitudinal sectional view of a multicolor marker in accordance with a sixth embodiment of this invention with its opening parts in one position; and FIG. 25 is a similar view showing the operating parts of the FIG. 24 marker in a different position.

DETAILED DESCRIPTION OF THE INVENTION

Before explaining the present invention in detail it is to be understood that the invention is not limited in its application to the particular arrangements shown and described herein since the invention is capable of other embodiments. Also, the terminology used herein is for the purpose of description and not of limitation.

Figure 1:
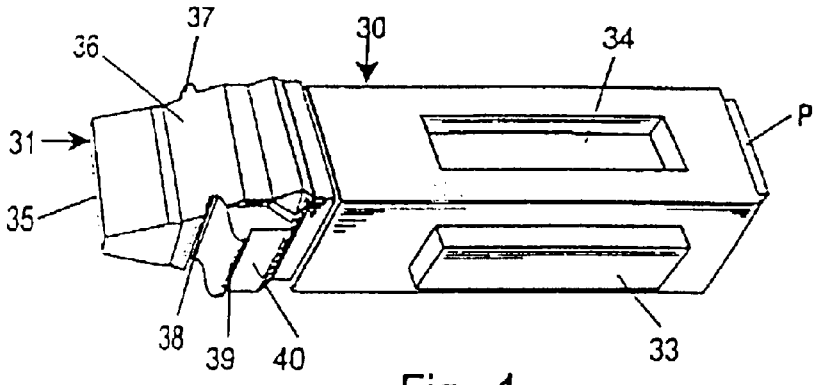
FIG. 1 is a perspective view of a marker module in accordance with a first embodiment of this invention.
Figure 2:
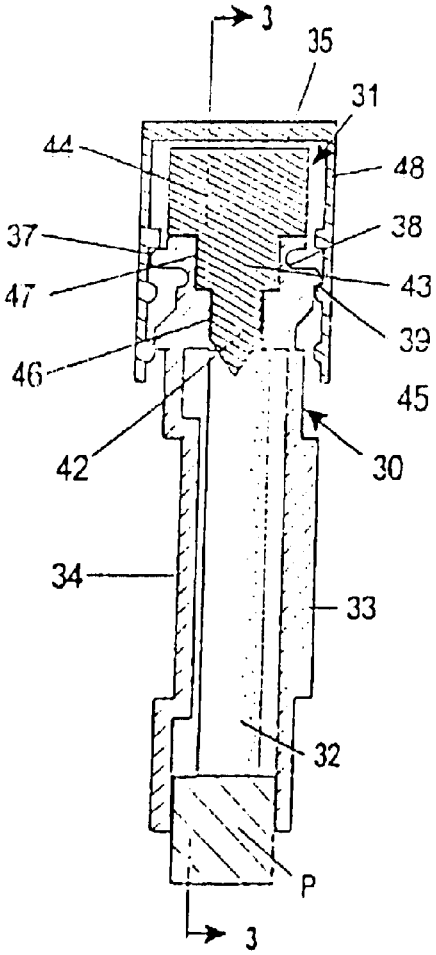
FIG. 2 is a longitudinal section through this marker module with a cap attached and covering the marking nib.
Figure 3:
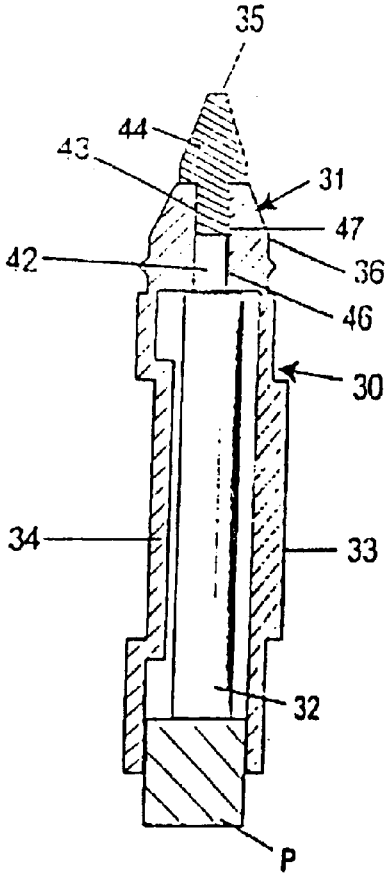
FIG. 3 is a longitudinal section taken along the line 3—3 in FIG. 2 and with the cap removed.

FIGS. 1–3 show a marker module in accordance with a first embodiment of the invention having a novel and advantageous construction which enables any desired number of such modules to be attached to each other, and removed from each other, from the side to provide a corresponding number of marking nibs that may be positioned with their elongated marking surfaces either end-to-end or in spaced parallel relationship.

The marker module in accordance with this embodiment of the invention comprises an elongated hollow housing or body 30 of square cross-section which holds a supply of ink that is fed in any suitable manner to a tapered marking nib 31 of suitable porosity on one end of the housing. FIGS. 2 and 3 show this ink supply as a cylinder 32 that holds ink of a particular color or shade. A manually insertable and removable plug P closes the opposite end of housing 30 to keep the ink cylinder 32 positioned to feed ink to the marking nib 31.

On two of its four sides the housing 30 of the marker module presents an outwardly extending protrusion 33 of rectangular cross section which is elongated lengthwise of the housing FIG. 1. On each of the remaining sides (opposite those on which the protrusions are located) the housing presents a complementary recess 34 for closely receiving a protrusion 33 on a second marker module identical to the one shown in FIGS. 1–3.

The modules that make up any particular multiple-module marker are attached to one another from the side (i.e., by moving them together perpendicular to the direction of elongation of each marker) to provide a snap-in reception of a protrusion 33 on one module in a recess 34 in a neighboring module. Thus, the protrusions 33 and recesses 34 constitute a retainer means for holding the modules side-by-side. The marker modules can be manually detached by pulling them apart from the side.

As shown in FIG. 1, the exposed marking face 35 at the apex of each marking nib 31 is elongated from side-to-side coextensive with the width of the module housing 30 where the protrusion 33 and recesses 34 are not present. FIG. 1 shows this marking face 35 as having a narrow width perpendicular to its length but, if desired, it may be in the form of a sharper V-shaped edge, or rounded, or any other desired shape instead.

Figure 4:
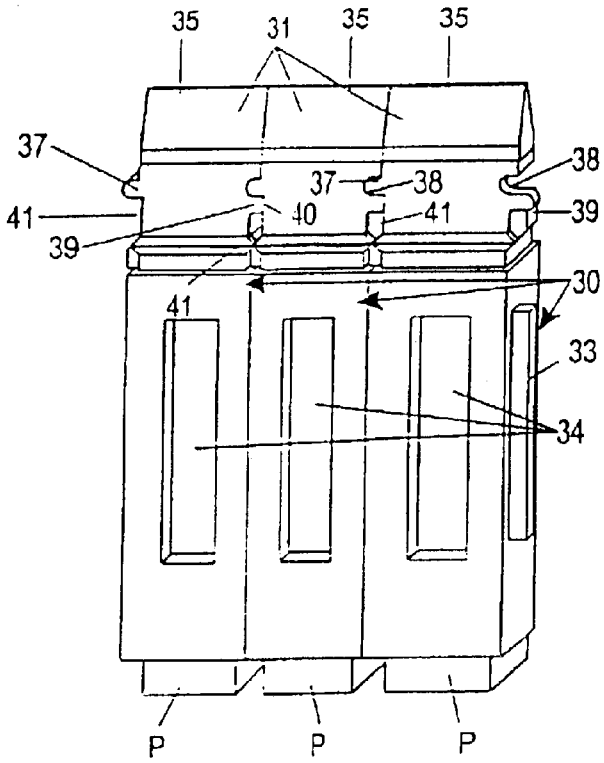
FIG. 4 is a perspective view of a multicolor marker having three of the FIG. 1 marker modules attached to each other side-by-side with their respective marking nibs end-to-end.

As the end of the marker module housing 30 where the marking nib 31 is located, this housing presents a tapered end segment 36 having an outwardly protruding, rounded lip 37 on one side (FIGS. 1 and 2) and a complementary groove 38 in the opposite side at the same location longitudinally of the marker module for receiving the lip 37 on a neighboring module with a manually insertable and removable snap-in fit. On the side where the groove 38 is located, the marking nib 31 presents an outwardly protruding lip 39 just below groove 38 for snug engagement with the underside of the lip 37 on the marking nib of a neighboring module when the modules are positioned with their marking nibs arranged end-to-end (FIG. 4). Each lip 39 presents an outer surface 40 for abutting engagement with a flat peripheral surface 41 on the marking nib of the neighboring marker module below the lip 37 on the neighboring module.

As shown in FIG. 2, the marking nib 31 of this marker module is of stepped configuration, presenting a pointed inner end segment 42 extending into the ink container 32 to receive ink therefrom, a wider middle segment 43, and an even wider outer end segment 44 that terminates in the marking edge 35. This end of the marker module housing 30 presents an opening 46, 47 shaped complementary to the inner end and middle segments 42 and 43 of marking nib 31 for holding the marking nib securely in place in liquid-tight fashion on housing 30. A manually attachable and removable cap 48 may be applied to this end of the marker module housing to cover the marking nib 31 when this marker module is not in use.

FIG. 4 shows three such marker modules (with the caps 48 removed) attached together in a unitary assembly with their marking nibs 31 positioned end-to-end, so that the marking edge 35 of one is a continuation of the marking edge of its neighbor for producing a continuous wide line whose color (or shade of one color) changes from one marking nib 31 to the next. In this arrangement the lip 37 on one marker module interlocks with the recess 38 in a neighboring marker module.

Figure 5:
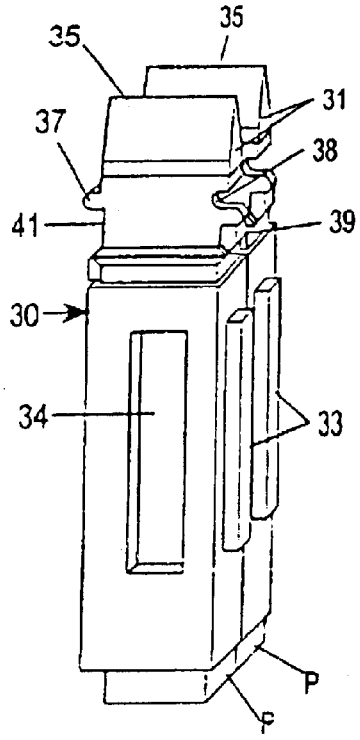
FIG. 5 is a perspective view of a two-color marker with two of the FIG. 1 marker modules attached to each other with their marking nibs parallel.

Alternatively, as shown in FIG. 5, the marker modules may be attached in such a manner as to position their marking edges 35 in spaced parallel relationship to produce separate parallel lines, each of a width corresponding to that of the narrow dimension of the respective marking edge. In this arrangement, the lips 37 and grooves 38 on adjoining marker modules do not interlock but a protrusion 33 on the housing 30 of one module interlocks with a recess 34 in the housing of the adjoining module. It is to be understood that any desired number of marker modules may be attached to one another in the manner shown in FIG. 5 to produce a corresponding number of parallel markings.

If desired, instead of the protrusions 33 and recesses 34 on the sides of each marker module they may be connected in a manually attachable and detachable manner by various other types of snap fasteners, thin flat permanent magnet strips, or "Velcro"® strips on their respective sides.

Figure 6:
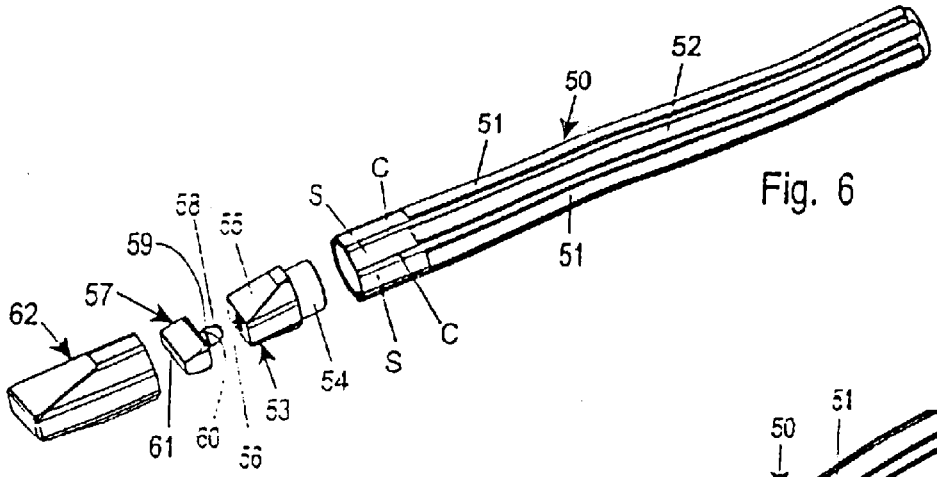
FIG. 6 is an exploded perspective view of a single marker module in accordance with a second embodiment of this invention.

FIG. 6 shows a marker module in accordance with a second embodiment of the present invention which has a novel and advantageous construction enabling such modules to be attached to one another to extend side-by-side or detached from each other by slidably displacing one module longitudinally of its neighbor.

In accordance with this embodiment, each marker module comprises an elongated hollow housing or body 50 having eight equal-sized longitudinal sides S separated by narrow connecting segments C. Every other side S carries an outwardly extending protrusion 51, which may be a strip adhesively attached to that side of the housing or may be formed integral with that side. While this protrusion 51 is shown as rectangular in cross-section, it may be of any other suitable cross-section. The remaining sides S of the housing 50 (i.e., the ones without the protrusions 51) are formed with longitudinal grooves 52 complementary to the protrusions 51, so that one such module can be attached to a second one by aligning its protrusion 51 with a groove 52 in the second module at the latter's back end (the right end in FIG. 6) and sliding the two modules longitudinally toward one another to assemble into a unitary marker having the two modules interconnected. Thus, the interconnected protrusions 51 and grooves 52 constitute a retainer means for holding the modules side-by-side.

Figure 9:
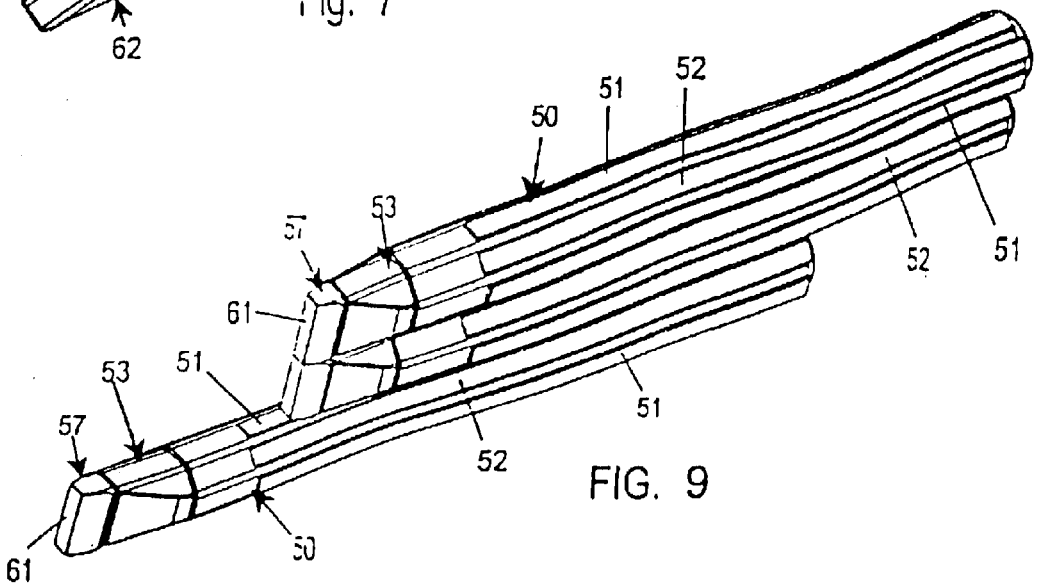
FIG. 9 is a perspective view of three of the FIG. 6 marker modules partly assembled for providing a three-color marker.

Any desired number of such modules may be attached together in this manner, such as the three modules shown partially assembled in FIG. 9.

In addition to the housing 50, the marker module of FIG. 6 has a nib holder 53 with a reduced inner end segment 54 that is slidably insertable into the front end of housing 50 (the left end in FIG. 6) and is held therein with a tight fit. Holder 53 has a tapered outer end segment 55 formed with a circular axial opening 57.

A marking nib 57 in this marker module has a slightly conical inner end segment 58 that may be forced manually into the holder opening 56. At the outer end of segment 58 the marking nib presents a transverse annular shoulder 59 for engagement with the end face of holder 53 around the latter's opening 56 and a cylindrical stem 60 extending outward from this shoulder and having a snug but rotatable fit in the holder opening 56, enabling the marking nib to be turned to various positions angularly about the axis of holder 53 (which is conjoint with the axis of the marker module housing 50).

The marking nib is of suitable porosity to pass ink to a flat marking surface 61 on its outer end that is elongated in one direction and narrow perpendicular to that one direction.

Figure 8:
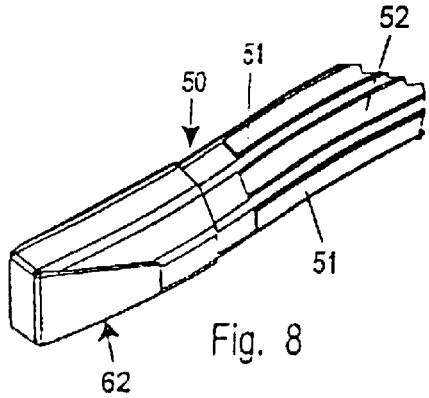
FIG. 8 is a perspective view of the same parts of this marker module as shown in FIG. 7 but with the end cap attached and covering the marking nib.
Figure 7:
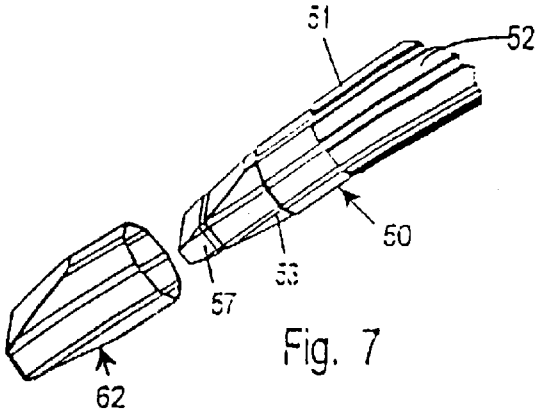
FIG. 7 is a fragmentary perspective view showing the marking nib of the FIG. 6 marker module attached to its housing and the end cap removed from the marker module.

An end cap 62 fits snugly over the marking nib 56 and its holder 53 when the marker module is not in use, as shown in FIG. 8.

Figure 10:
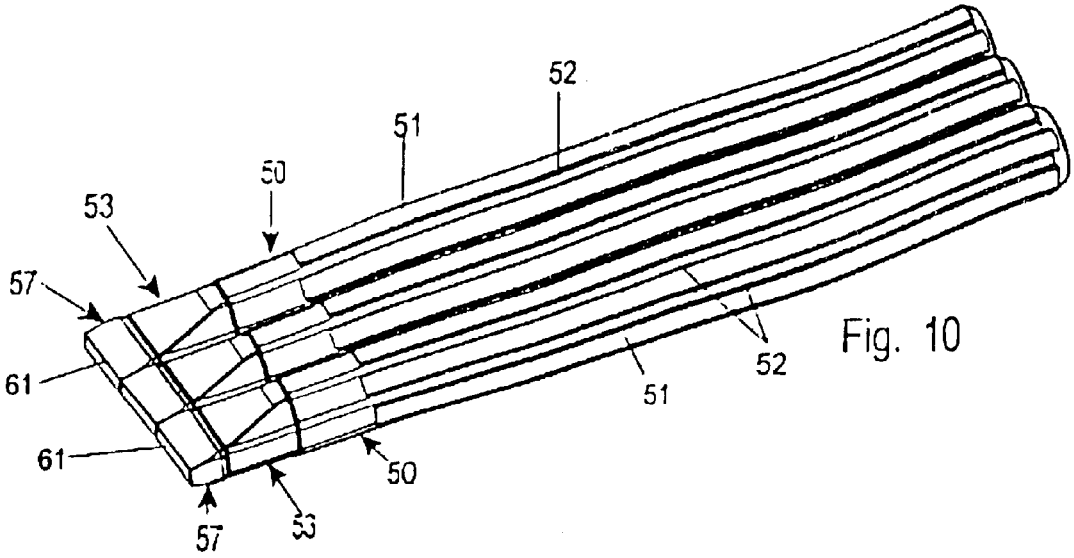
FIG. 10 is a perspective view of three FIG. 6 marker modules fully assembled together and forming a three-color marker.

FIG. 10 shows three of the FIG. 6 modules connected together and having their marking nibs aligned end-to-end to produce a continuous line whose color or shade changes from one marking nib to the next. However, it is to be understood that each marking nib 57 may be turned, as described, to separate the particular color segment that it draws from the color segments drawn by the other marking nibs in the unitary assembly and to reduce the width of its color segment in accordance with the angular position of that marking nib.

It is to be understood that, if desired, the laterally attachable marker modules of FIGS. 1–5 may be provided with respective rotatably adjustable marking nibs, such as the one shown in the longitudinally attachable marker modules of FIGS. 6–10.

FIGS. 11–14 show a third embodiment of the invention that is similar in many respects to the embodiment of FIGS. 6–10 except that there are no protrusions and grooves on the sides of the marker module housings. Instead the marker modules are held in place by an end cap common to all of them. Elements of each marker module in FIGS. 11–14 which correspond to elements of the FIG. 6 module are given the same reference numerals plus 100, so that the detailed description of these corresponding elements need not be repeated.

Figure 11:
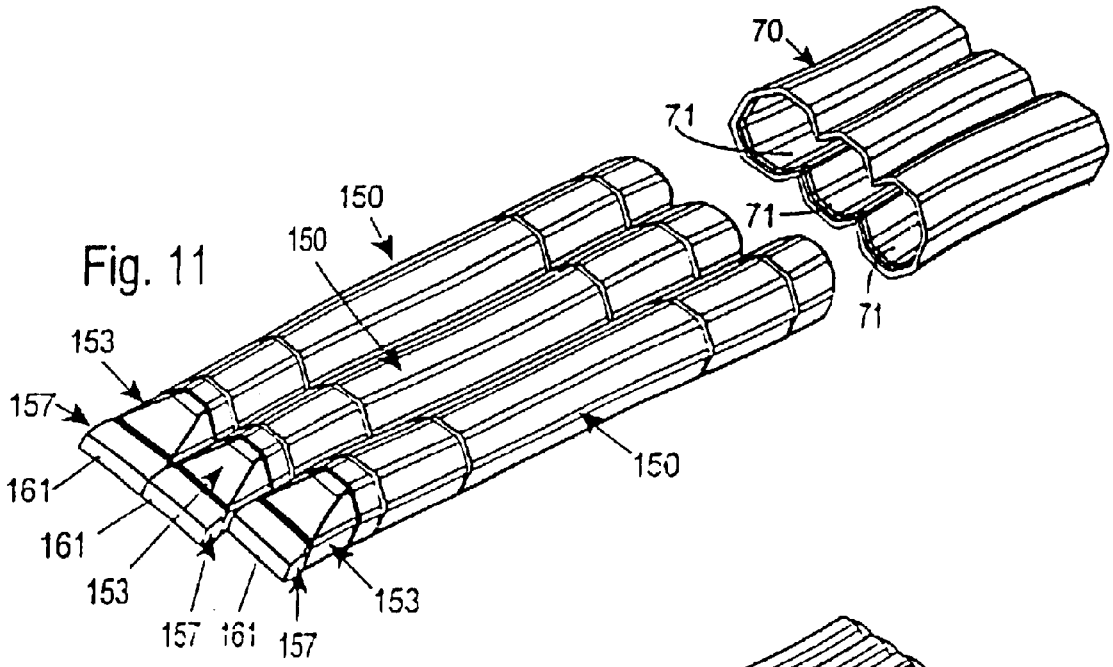
FIG. 11 is an exploded perspective view of three marker modules in accordance with as third embodiment of this invention and an end cap for the three modules to position them for use as a three-color marker.

As shown in FIG. 11, the end cap 70 is formed with three longitudinal recesses 71 for snugly but slidably receiving the marker module housings 150 at either end of the latter.

Figure 12:
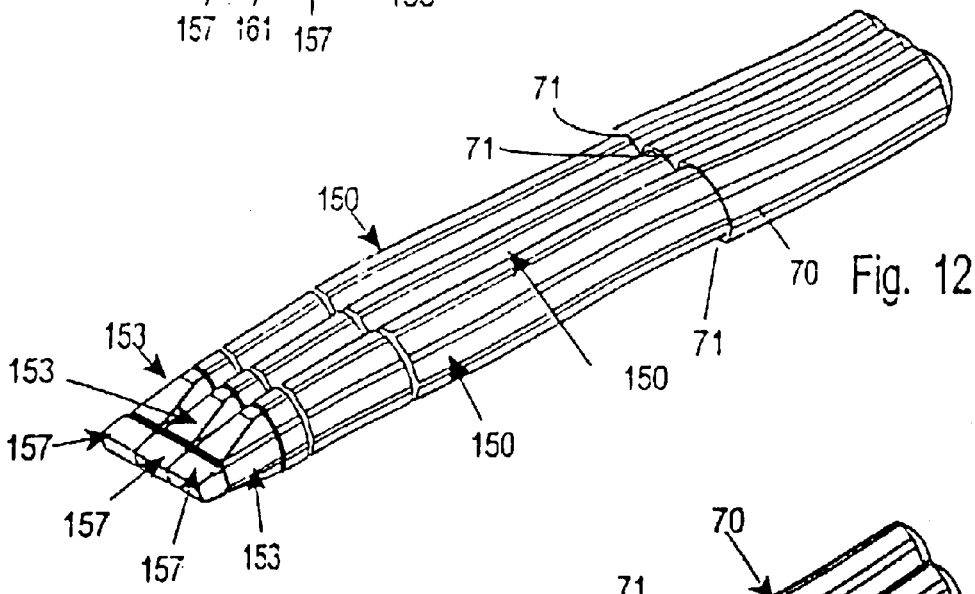
FIG. 12 is a similar view showing the marker modules held together in their respective marking positions by the end cap.

FIG. 12 shows three marker modules held in their operative (marking) positions by end cap 70, which is the retainer means for holding the modules side-by-side. This Figure shows the porous marking nibs 157 of the marker modules aligned end-to-end for drawing a continuous mark whose color (or shade) changes from one marking nib to the next. However, it is to be understood that any of the marking nibs 157 can be turned in its holder 153, as described in detail for the embodiment of FIGS. 6–10, to provide spacing between the color segment it draws and the neighboring ones and to narrow the color segment it draws in accordance with its rotational adjustment in its holder 153. Also, if the marker tip and its holder are formed as an integral unit, with no adjustability between them, the marker module 150 as a whole may be turned before insertion in the end cap 70 so that its marking nib is at an angle to neighboring marking nibs and not aligned with them end-to-end.

Figure 13:
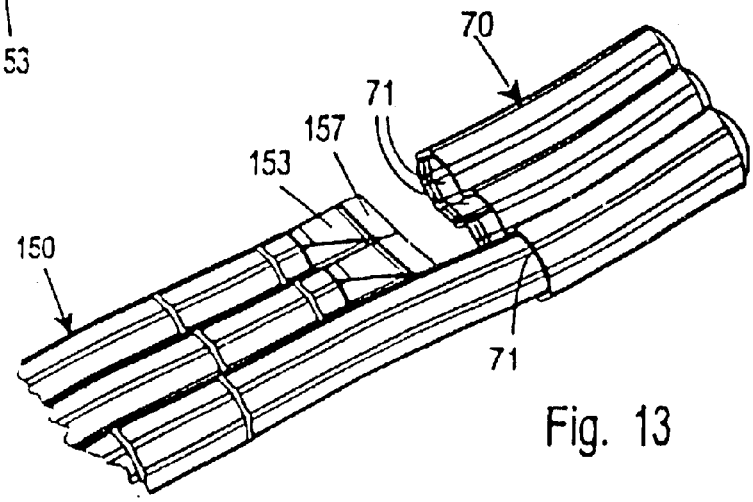
FIG. 13 is a fragmentary perspective view of the marker modules and holder assembly of FIGS. 11 and 12 when the end cap is to be used as a cover for the marking nibs of the marker modules.
Figure 14:
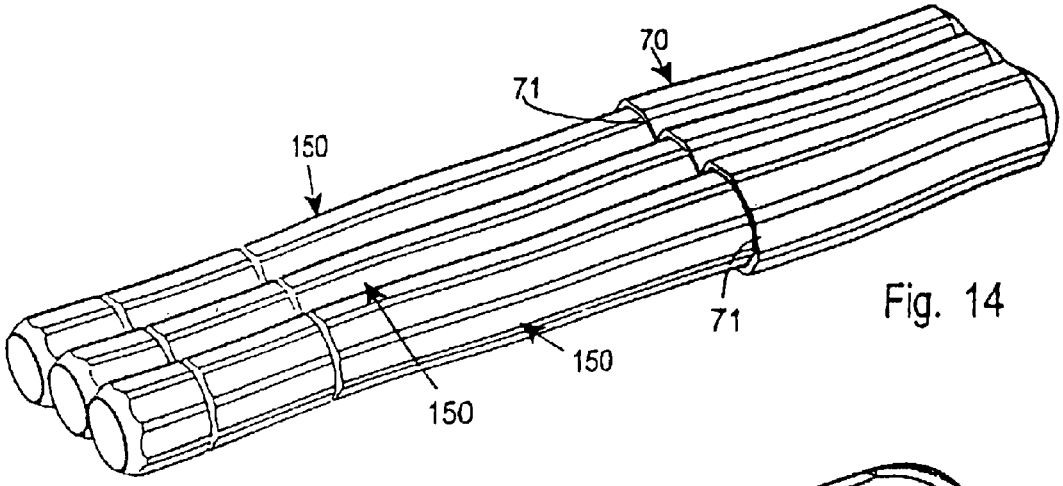
FIG. 14 is a perspective view showing the end cap in place on the marking nibs of all three marker modules of the type shown in FIG. 11.

As shown in FIG. 13, when the multicolor marker is not to be used, the non-marking ends of its modules can be removed from end cap 70 and the modules can be reversed end-to-end so that their respective marking nibs 157 and their holders 153 can be inserted into the respective end cap recesses 71. FIG. 14 shows the final position of the parts of the marker assembly in its non-operating condition, with the end cap 70 holding and covering the marking ends of the three marker modules.

FIGS. 15–21 show a fourth embodiment of the invention which has a plurality of marker modules that are individually extensible to a marking position and retractable from that position with respect to a housing that holds all of them.

Figure 17:
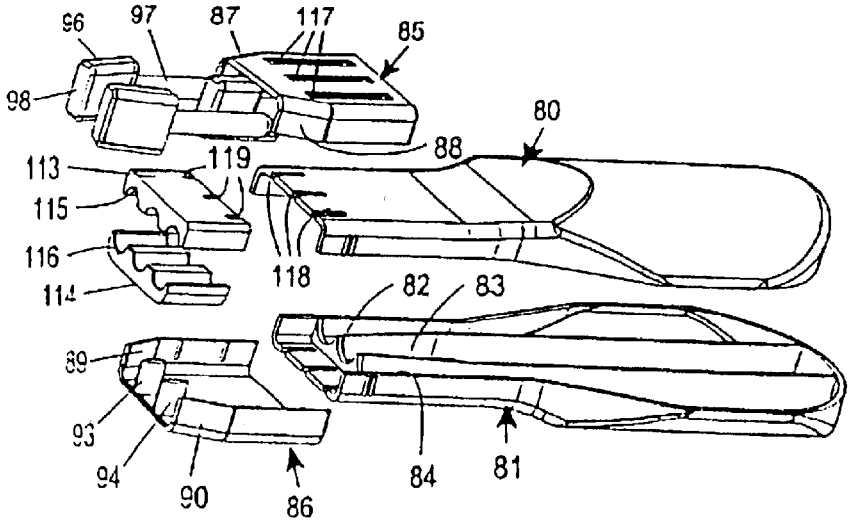
FIG. 17 is an exploded perspective view of the marker of FIGS. 15 and 16.
Figure 18:
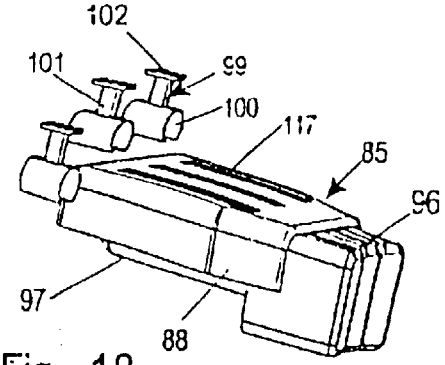
FIG. 18 is a fragmentary exploded perspective of this fourth embodiment of the present invention showing the marking nibs of the three modules, the individual slidable carriers that extend and retract these marking nibs, and a slotted part of the marker housing that slidably receives these carriers.
Figure 19:
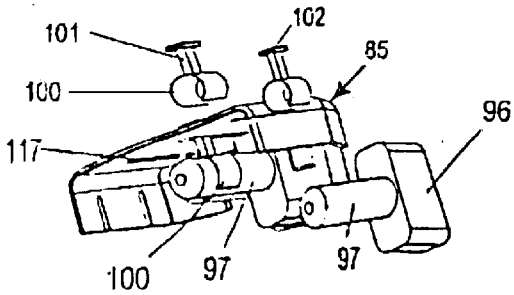
FIG. 19 is a different fragmentary exploded perspective view of this slotted housing part and two of the marking nibs and their slidably adjustable carriers.

As shown in FIG. 17, the marker housing an elongated main top piece 80 and a similar main bottom piece 82 that may be secured to each other by any suitable means, such as adhesive or screws, to define between three longitudinally elongated chambers 82, 83 and 84 for holding respective ink supplies, such as ink containers, of different colors or shades. The marker housing has an inverted upper front piece 85 of generally channel-shaped cross-section that fits down over the front end of the main top piece 80. Also, the marker housing has a lower front piece 86 of generally channel-shaped cross-section that fits under the front end of the main bottom piece 82 and registers with and abuts the upper front piece 85.

Figure 20:
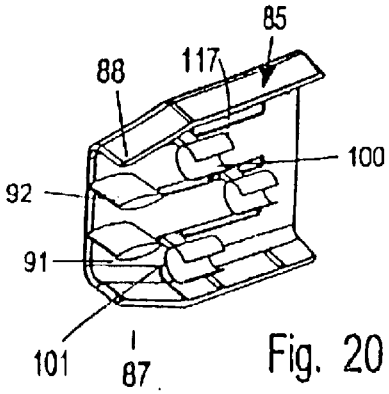
FIG. 20 is a bottom perspective view of the slotted housing part and the three slidable adjustable carriers for the marking nibs.

The upper front piece 85 of the marker housing has depending opposite side segments 87 and 88 at its front end that taper inwardly and forwardly. Similarly, the lower front housing piece 86 has similarly tapered upstanding side segments 89 and 90 at its front end that register respectively with the tapered side segments 87 and 88 on the upper front piece. Between its side segments 87 and 88 at the front, the upper front piece 85 has a pair of laterally spaced, slightly rounded, downwardly extending, vertical dividers 91 and 92 (FIG. 20). Similarly, as shown in FIG. 17, the lower front piece 87 has a pair of similar upwardly extending dividers 93 and 94 that register with and abut against the dividers 91 and 92 on the upper front piece just inside the front end of the marker housing. The tapered front side segments 87 and 89 at the same side of the upper end lower front pieces 85 and 87 of the marker housing, the aligned dividers 91 and 93 on these housing front pieces, and the top and bottom walls of the front pieces together define a first passage at one side of the front end of the marker housing for a first extensible and retractable marking nib 96. The aligned dividers 91 and 93, the aligned dividers 92 and 94, and the top and bottom walls of the upper and lower front pieces of the marker housing together define a second passage for a second extensible and retractable marking nib at the middle of the front end of the marker housing. The aligned dividers 92 and 94, the tapered front side segments 88 and 90 on the upper and lower front pieces 85 and 86 of the marker housing, and the top and bottom walls of the front pieces together define between them a third passage for a third extensible and retractable marking nib in the front end of the marker housing at the opposite side.

The marker modules are identical, each consisting of a marking nib 96 on the outer end (FIG. 17) and a cylindrical shank 97 extending behind the marking nib and communicating with the corresponding ink reservoir in the main housing. Both the marking nib 96 and the shank 97 are of suitable porous material for passing ink from the ink supply in the corresponding chamber 82, 83 or 84 of the marker housing to the outer marking face 98 of the marking nib. Each marker module is held by a carrier 99 having a spring clip 100 on its lower end that grips the shank 97 of the marker module, a thin rigid stem 101 extending up from the spring clip, and a slider 102 with corrugated top face at the upper end of the stem. The marker housing also has upper and lower guide members 113 and 114 (FIG. 17) that fit closely inside the housing's upper and lower front pieces 85 and 87. The upper guide member 113 extends behind the depending vertical spacers 91 and 92 in the upper front piece 85 of the marker housing, and on either side of these spacers it presents three laterally spaced, downwardly facing, semi-cylindrical, longitudinal recesses 115, each for slidably receiving the upper half of the stem 97 of the corresponding marker module.

The two recesses 115 on either side converge at a slight angle in the forward direction (i.e., toward the left in FIG. 17). The lower guide member 114 is essentially a mirror image of the upper guide member 113, presently three laterally spaced, upwardly facing, semi-cylindrical, longitudinal recesses 116, each for slidably receiving the lower half of the stem 97 of the corresponding marker module. The lower guide member fits closely inside the marker housing's lower front piece 87 behind its upstanding vertical dividers 93 and 94. When the upper and lower halves of the marker housing are put together, the upper and lower guide members 113 and 114 abut, with their corresponding upper grooves 115 and lower grooves 116 in registration to form cylindrical guide passage for the stems 97 of the corresponding marker modules.

Figure 21:
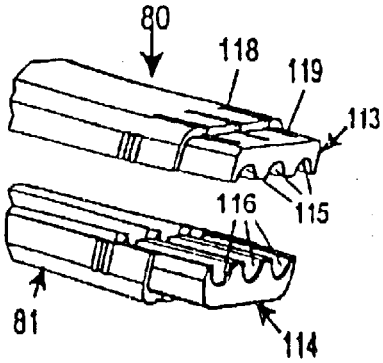
FIG. 21 is a fragmentary exploded perspective view showing other parts of the marker housing in this fourth embodiment of the invention.

The top wall of the upper front piece 85 of the marker housing has three longitudinally extending, elongated narrow openings 117 (FIG. 17), each for receiving the stem 101 of the corresponding carrier 99, with the carrier's slider 102 positioned just above the top wall of the upper front piece. The openings 117 on either side converge in the same manner as the corresponding recesses 115 and 116 in the upper and lower guide members 113 and 114. The main top piece 80 of the marker housing is formed with three laterally spaced slots 118 extending longitudinally rearward from its front edge and aligned individually with corresponding openings 117 in the upper front piece 85. The upper guide member 113 is formed with corresponding slots 119 extending forward from its back edge as continuations or extensions of the slots 118 in the housing's main top piece 80, as best seen in FIG. 21.

Figure 15:
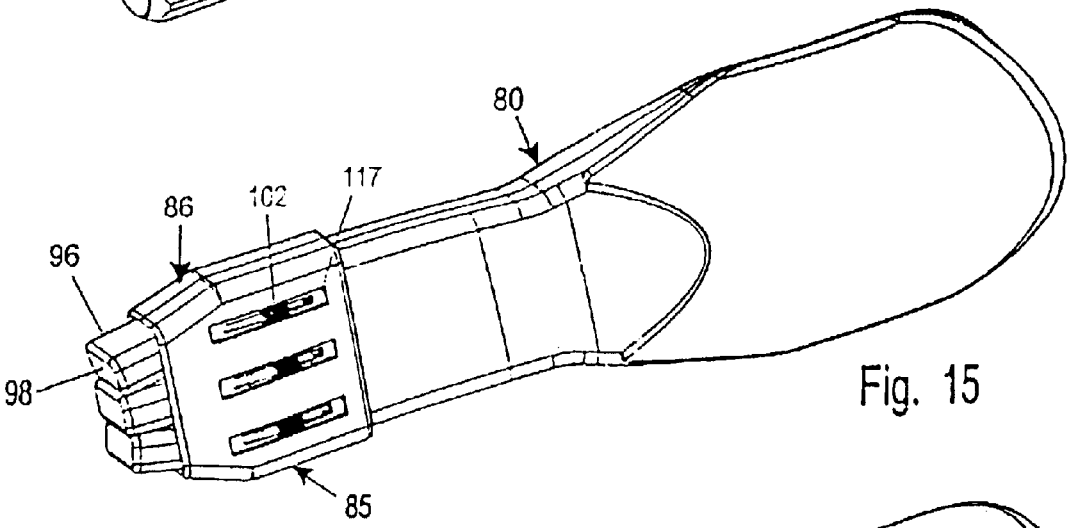
FIG. 15 is a perspective view of a three-color marker in accordance with a fourth embodiment of this invention which has devices for extending and retracting the marker modules individually, showing three marker modules fully extended to their marking positions next to one another.
Figure 16:
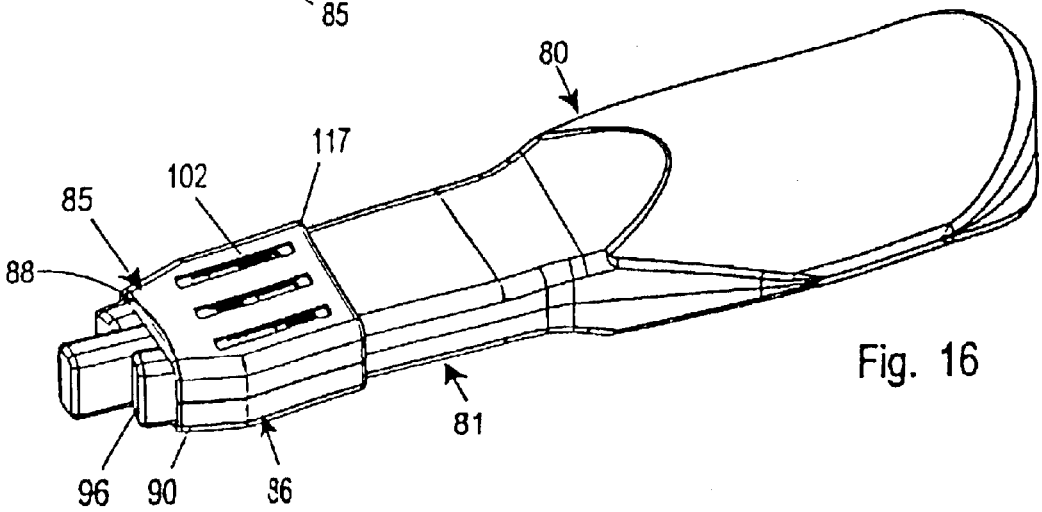
FIG. 16 is a perspective view of the FIG. 15 marker with one of the marker modules extended well beyond the other two.

With this arrangement, the slider 102 of each carrier 99 is individually adjustable along the respective longitudinal opening 117 in the marker housing's upper front piece 85 to position the corresponding marking nib away from or toward the front end of the marker housing. When the marking nibs are fully retracted, their marking faces are slightly spread apart. When all three marking nibs are extended, their front edges (at their marking faces) abut, as shown in FIG. 15, so that they will deposit their respective ink colors side-by-side on the drawing surface. FIG. 16 shows one of the marking nibs extended well beyond the others, so that only its ink would be deposited on the drawing surface.

FIGS. 22 and 23 show a fifth embodiment of this invention in which the marker housing 200 holds three separate ink reservoirs 201, 202 and 203 that supply marking ink of different colors or shades to corresponding individual porous marking nibs 204, 205 and 206. A tapered annular holder 207 for the three nibs is adjustable longitudinally of the housing 200 between a retracted position (FIG. 22) and an extended position (FIG. 23). In the retracted position a rounded annular lip 208 projecting from holder 207 engages behind a first inwardly projecting lip 209 on the inside of marker housing 200. In the extended position of holder 207 its inside lip 208 engages behind a second inwardly projecting lip 210 on the inside of housing 200 that is located closer to the latter's front end (the upper end in FIGS. 22 and 23). In moving from either of these positions to the other, the nib holder 207 snaps into place with an audible click.

At the open front end of nib holder 207 a rounded divider 211 separates nibs 204 and 205, and a similar divider 212 separates nibs 205 and 206. The outer side of nib 204 slidably engages the rounded inside surface 213 of nib holder 207 at this side of its open front end. Similarly, the outer side of nib 206 slidably engages the rounded inside surface 214 of nib holder 207 at this side of its front end. Because of the inward taper of the nib holder 207 toward its front end, the nibs 204 and 206 on either side converge toward the middle nib 205.

When nib holder 207 is snapped into its retracted position (FIG. 22), the marking nibs 204, 205 and 206 are in their operative, marking positions, abutting each other in succession across the front end of the marker.

When nib holder is snapped into its extended position (FIG. 23), its dividers 211 move forward along the neighboring sides of nibs 204, 205 and 206 and spread them apart slightly at their front ends. In the extended position of the nib holder, its open front end is slightly forward of the marking surfaces of the nibs, so this is their inoperative, non-marking position.

Thus, in the embodiment of FIGS. 22 and 23 there is only slight lateral movement of nibs 204 and 206 and no movement of the middle nib 205 between the marking and non-marking positions of the nibs. Instead, it is the nib holder 207 that moves significantly with respect to the marker housing 200 to establish either the marking position or the non-marking position of the nibs.

FIGS. 24 and 25 show a sixth embodiment of the invention which is generally similar to the embodiment of FIGS. 22 and 23 except that it has separate holders for the three marking nibs.

The middle nib 225 in this sixth embodiment of the invention is held by a ring 240 fixedly attached to the marker housing 220 in any suitable manner. Thus, the middle nib 225 is fixedly positioned with respect to the marker housing.

The marking nib 224 located on one side of the marker is carried by an individual holder 241 that is slidably adjustable longitudinally of the marker housing between a retracted position (FIG. 24) and an extended position (FIG.

25). Holder 241 has a rounded external lip 242 at its back end that engages behind a first rounded internal lip 243 on the marker housing in the retracted position of holder 241 (FIG. 24) and engages behind a second rounded internal lip 244 on the marker housing in the extended position of holder 241.

The marking nib 206 on the other side is carried by an individual holder 245 that is a mirror image of holder 241. Holder 245 has a rounded external lip 246 for engaging behind first and second lips 247 and 248 on the marker housing in the retracted and extended position of holder 245.

When both nib holders 241 and 245 are retracted, the nibs 224 and 226 on each side abut the middle nib 225 at their front ends, and their marking surfaces there extend in succession contiguously from one to another.

When the holder 241 for nib 224 is extended, it slides the front end of that nib forward past the front end of the middle nib 225, so that nib 224 would be in its marking position but the middle nib would not. Likewise, when the holder 245 for nib 226 is extended, it slides the front end of that nib forward beyond the front end of the middle nib 225. FIG. 25 shows both holders 241 and 245 in their extended positions, thereby putting their nibs 224 and 226 in their respective marking positions for producing closely spaced parallel markings of different colors or shades on the drawing surface.

With this arrangement, all three marking nibs can be in their respective marking positions (FIG. 24), or the nibs 224 and 226 on both sides can be in their marking positions and the middle nib not (FIG. 25), or either nib 224 or 226 alone can be in its marking position and the others not.

Each of the foregoing embodiments of the present invention overcomes difficulties I have experienced as an artist using a single one-inch wide watercolor brush with a wool felt tip, different portions of which I stroke onto three to five different colors of water-based paint and then use the brush to apply to a drawing surface the different colors that resemble animals, plants, insects and landscapes. Typically, I may use six such brushes to produce the different color combinations and various rainbow effects. The paint is in small jars, each provided with a protruding sponge that wicks paint from the bottom of the jar. These sponges require careful maintenance to prevent drying and hardening. Also, the jars have to be refilled often and the dilution of its paint adjusted as the solvent evaporates. All of this takes the artist's time and attention away from the task at hand, and it is particularly troublesome for artwork by children.

The present invention obviates these difficulties and provides a very flexible, easy to use arrangement that enables the user to conveniently select among different colors and produce a variety of pleasing artistic effects, particularly multicolor lines with no gaps between adjacent colors.

I claim:

1. A multicolor marker comprising: a plurality of marking nibs, each having a marking surface that is elongated in one direction; means for supplying different colored inks individually to said nibs; and positioning means for selectively positioning said nibs in marking position adjacent one another with their respective marking surfaces aligned in said one direction of elongation of each; wherein said positioning means is selectively operable to position said nibs contiguous to one another for producing an elongated line with contiguous segments of different colors; wherein said positioning means comprises: a plurality of marker module housings, each holding one of said marking nibs; and retainer means for selectively holding said housings side-by-side.

2. A marker according to claim 1 wherein said marking surface of each of said nibs is as wide in said one direction thereof as the corresponding housing.

3. A marker according to claim 2 wherein said retainer means comprises manually attachable elements on the sides of sides housings.

4. A marker according to claim 3 wherein said retainer elements are protrusions and complementary recesses at circumferentially spaced locatins on the periphery of each of said housings for mating engagement with complementary recesses and protrusions on adjoining housings when the housings are brought together laterally.

5. A marker according to claim 3 wherein said retainer elements are elongated protrusions on the outside of said housings and elongated grooves on the outside of said housings which are complementary to said protrusions for snugly but slidably receiving said protrusions on adjoining housings when the housings are slid together longitudinally.

6. A marker according to claim 1 wherein said retainer means comprises manually attachable retainer elements on the sides of said housings.

7. A marker according to claim 6 wherein said retainer elements are attachable by bringing the housings together laterally.

8. A marker according to claim 6 wherein retainer elements are attachable by bringing the housings together longitudinally.

9. A marker according to claim 1 wherein said retainer means comprises an end cap presenting recesses for snugly but slidably receiving said housings to hold said housings side-by-side.

10. A marker according to claim 2 wherein said retainer means comprises an end cap presenting recesses for snugly but slidably receiving said housings to hold said housings side-by-side.

* * * * *